US006629650B2

(12) United States Patent
Curran et al.

(10) Patent No.: US 6,629,650 B2
(45) Date of Patent: Oct. 7, 2003

(54) FUEL INJECTOR WITH INTEGRAL DAMPER

(75) Inventors: Steven M. Curran, Hilton, NY (US); Ahmet T. Becene, Rush, NY (US); Charles Wilson Braun, Livonia, NY (US); Kern E. Haynes, Rush, NY (US); Leonard Lee Shebert, Jr., Pittsford, NY (US); Christopher A. Tucker, Pittsford, NY (US); David J. Thompson, Jr., Pittsford, NY (US); Brent Jack Wahba, Honeoye Falls, NY (US); Michael Raymond Raney, Mendon, NY (US); James M. Banna, Penfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/902,450

(22) Filed: Jul. 10, 2001

(65) Prior Publication Data

US 2003/0010847 A1 Jan. 16, 2003

(51) Int. Cl.[7] ..... F02M 63/00; F02M 51/00; B05B 1/34

(52) U.S. Cl. ..... 239/585.1; 239/533.2; 239/533.1; 239/533.3; 239/533.9; 239/533.12; 239/88

(58) Field of Search ..... 239/533.1, 533.2, 239/533.3, 533.4, 533.9, 533.11, 533.12, 533.14, 533.15, 585.4, 88, 90, 91, 93, 95, 96, 585.1; 251/129.15

(56) References Cited

U.S. PATENT DOCUMENTS

| | | | | | |
|---|---|---|---|---|---|
| 2,055,578 | A | | 9/1936 | Hurst | |
| 3,093,317 | A | * | 6/1963 | Simmons et al. | 239/533.2 |
| 3,159,349 | A | * | 12/1964 | Crocco et al. | 239/533.3 |
| 4,878,650 | A | * | 11/1989 | Daly et al. | 251/129.15 |
| 5,484,104 | A | | 1/1996 | Kukler | |
| 5,505,181 | A | | 4/1996 | McRae et al. | |
| 6,305,355 | B1 | * | 10/2001 | Hoffmann et al. | 251/129.16 |
| 6,314,942 | B1 | * | 11/2001 | Kilgore et al. | 123/467 |
| 6,363,915 | B1 | * | 4/2002 | Cohen | 239/533.11 |

FOREIGN PATENT DOCUMENTS

| | | | | |
|---|---|---|---|---|
| DE | 19958097 | A1 | 10/2000 | |
| EP | 0886066 | A1 | 12/1998 | |
| EP | 1036932 | A2 | 3/2000 | |
| EP | 1039122 | A1 * | 9/2000 | F02M/61/20 |
| JP | 57133806 | | 2/1982 | |
| JP | 2100809 | | 4/1990 | |

* cited by examiner

*Primary Examiner*—Robin O. Evans
(74) *Attorney, Agent, or Firm*—Patrick M. Griffin

(57) ABSTRACT

An engine fuel injector includes an internal fuel passage in which pressure waves can develop upon opening and closing of an injection valve. A fuel pressure damper is associated with the fuel passage and operates to vary the internal volume of the fuel passage in a manner to reduce the amplitude of pressure variations and pressure waves in the fuel passage. A variety of fuel pressure damper embodiments are disclosed.

12 Claims, 12 Drawing Sheets

FUEL INJECTOR WITH INTEGRAL DAMPER

TECHNICAL FIELD

This invention relates to fuel injectors for the fuel systems of internal combustion engines.

BACKGROUND OF THE INVENTION

Fuel injection systems for automotive engines may utilize a plurality of electromagnetic fuel injectors, each of which delivers fuel to an inlet port of an associated engine combustion chamber. The injectors may be mounted in sockets of a fuel rail which supplies fuel to each of the injectors. The injectors deliver fuel to the engine in metered pulses which are timed to control the amount of fuel delivered and to coordinate fuel delivery with engine operation. The sequential operation of the fuel injectors causes pressure pulsations within the fuel rail which can result in fuel line hammer and maldistribution of fuel from the fuel rail during engine operation.

U.S. Pat. No. 5,617,827 discloses a fuel rail for delivering fuel to multiple injectors of an engine through individual cup connectors spaced along the fuel rail. The fuel rail has a pulsation damper assembly mounted within the fuel conduit of the fuel rail. The damper assembly includes an enclosed air space bounded by compliant walls that flex to reduce peak pressure pulsations in the fuel rail during injector operation to minimize fuel line hammer and resultant fuel maldistribution.

SUMMARY OF THE INVENTION

The present invention provides engine fuel injectors which incorporate integrated pulsation dampers that act within the injectors to reduce the rate of change of internal fuel pressure due to opening and closing of the injector fuel injection valves. The reduced rate of fuel pressure change slows down the wave speed of the resultant pressure wave and results in a reduction of the amplitude of fuel pressure pulsations transmitted to an associated fuel rail or other fuel system. A number of embodiments of integrated pulsation dampers are disclosed.

These and other features and advantages of the invention will be more fully understood from the following description of certain specific embodiments of the invention taken together with the accompanying drawings.

DESCRIPTION OF THE PREFERRED EMBODIMENT

Figure 1:
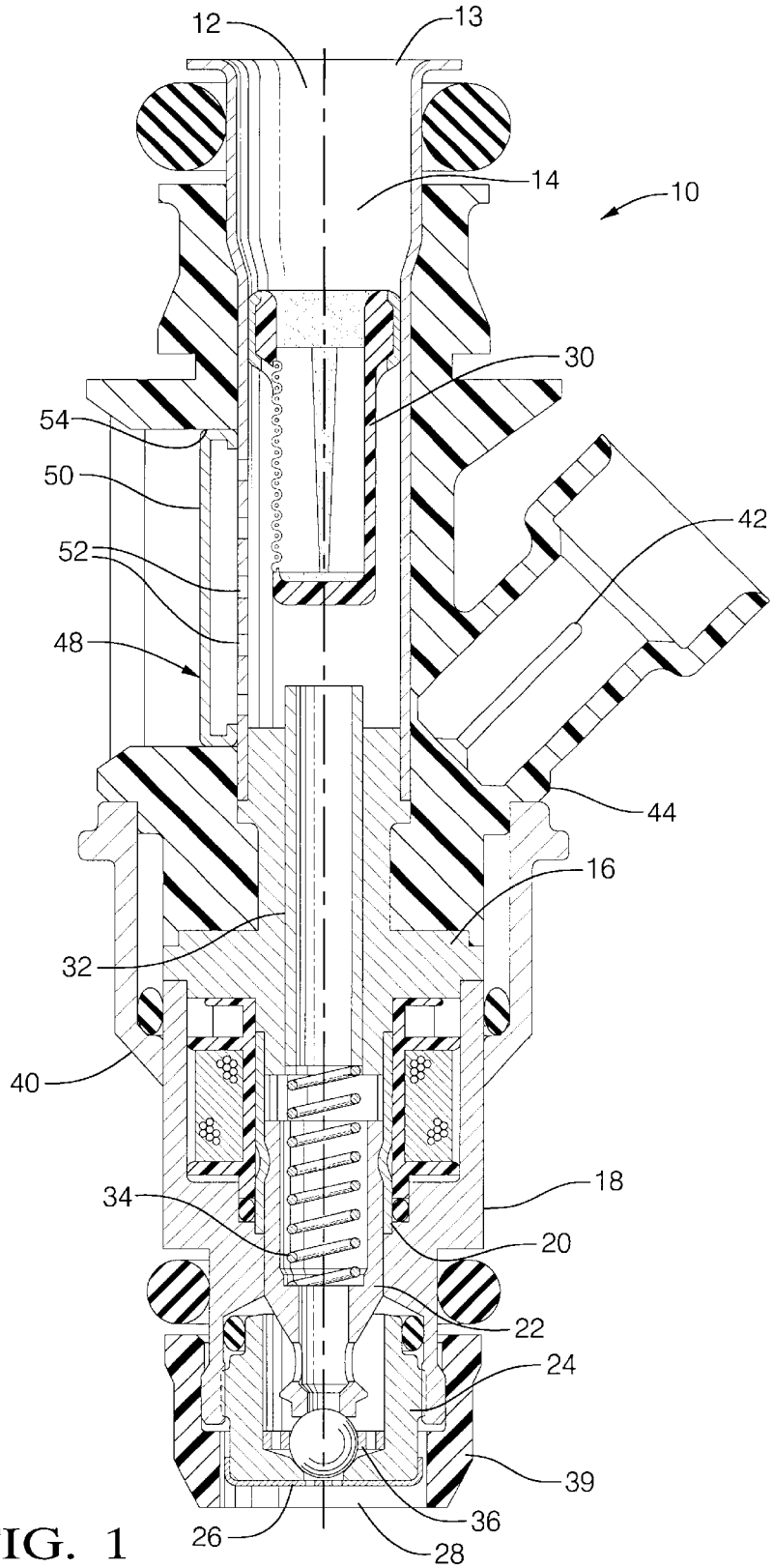
FIG. 1 is a cross sectional view of a known type of electromagnetic fuel injector modified to include an integrated fuel pressure pulsation damper according to the invention.

Referring first to FIG. 1 of the drawings in detail, numeral 10 generally indicates an electromagnetic fuel injector containing an integrated fuel pressure pulsation damper according to the invention. Injector 10 defines an internal fuel passage 12 having an inlet 13 and which is partially defined internally by a fuel tube 14 connecting with a pole piece 16. The pole piece connects with a valve body 18 and with an upper valve guide 20 in which an injection valve 22 reciprocates between open and closed positions. The valve body 18 carries a valve seat 24 having a seat surface, which a ball of the valve 22 engages to close the fuel passage 12 against the discharge of fuel to a spray director 26 at the outlet 28 of the fuel passage 12.

Within the fuel passage are, in the order of fuel flow, a fuel filter 30, a calibration sleeve 32 engaging a valve spring 34 that urges the valve closed, and a lower valve guide 36 guiding the ball portion of the valve 22. A coil assembly 38 in the valve body 18 is energized to open the valve by magnetic attraction of the valve 22 to the pole piece 16. A seal retainer 39 snaps onto the valve body 18 and retains a lower seal ring. A body retainer 40 extends around the upper end of the valve body 18. An electrical connector 42 for the coil assembly 38 is retained in an overmolded upper body 44 surrounding the fuel tube 14.

Figure 2:
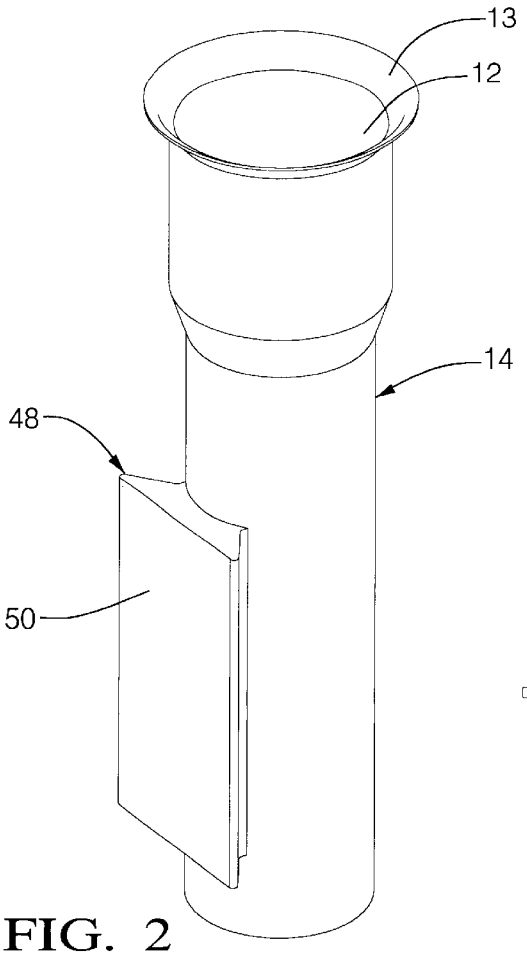
FIG. 2 is a pictorial view of the fuel tube for the injector of FIG. 1 showing the damper mounted on one side of the tube.

In an exemplary embodiment of the invention, shown in FIGS. 1 and 2, the fuel tube 14 is modified by the addition of a fuel pressure pulsation damper 48 on one side near the bottom of the tube. The damper 48 is formed as an open sided box having a flexible flat outer sheet 50 connected to four sides which are welded to the cylindrical lower portion of the fuel tube 14. The fuel tube and the damper are stainless steel, however other materials, including plastics, might be usable in some applications. The interior of the fuel tube is connected with the interior of the damper 48 by perforations 52 in the tube wall joining the two volumes. In the injector 10, the damper 48 protrudes into an opening 54 in the wall of the upper body 44 so that the flexible sheet 50 is exposed to external ambient pressure.

In operation of an engine having a fuel system containing the injector, opening and closing of the injection valve and the resultant beginning and ending of fuel flow through the injector cause pressure waves in the injector fuel passage 12 that travel out through the inlet into the connected fuel rail, not shown, and to the other injectors connected to the fuel rail. The damper responds to these pressure waves by flexing outward of the flexible sheet 50 as the pressure is increased and flexing inward of the sheet 50 as the pressure in decreased. The flexing varies the injector internal fuel passage volume and thus reduces the rate of change of pressure in the injector and the rate of change of fuel flow. The wave speed and amplitude of the fuel pressure variations or pulsations are thereby reduced and the adverse effects of pressure changes on the fuel system and other injectors in the system are at least partially alleviated.

In order to obtain the most effective results, the design of the damper 50 must be optimized for the type and size of injector to which it is applied and the inertia of the fuel system in which it is applied. Thus, the fuel characteristics, resilience of the fuel system components and the flexibility of the damper flexing component(s) are among the characteristics which should be considered in the selection and sizing of a particular design. Further examples of various embodiments of pulsation dampers, which could be used internally of or integral with individual injectors of an engine fuel system, are illustrated in the additional figures of the drawings and discussed below.

Figure 3:
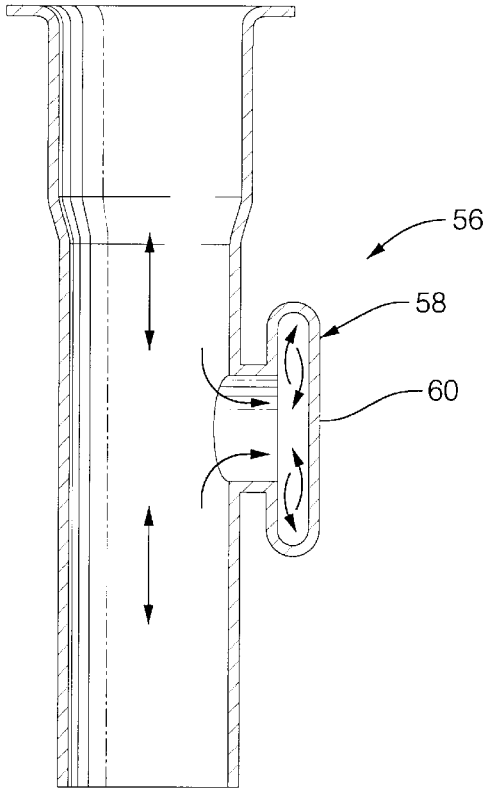
FIG. 3 is a cross sectional view of a fuel tube similar to FIG. 2 with a modified damper having a T shape in cross section.

FIG. 3 shows a fuel tube 56 similar to FIG. 2 but where the damper 58 appears as a "T" in cross section and could have a circular or polygonal flat sheet 60 for damping pulsations.

Figure 4:
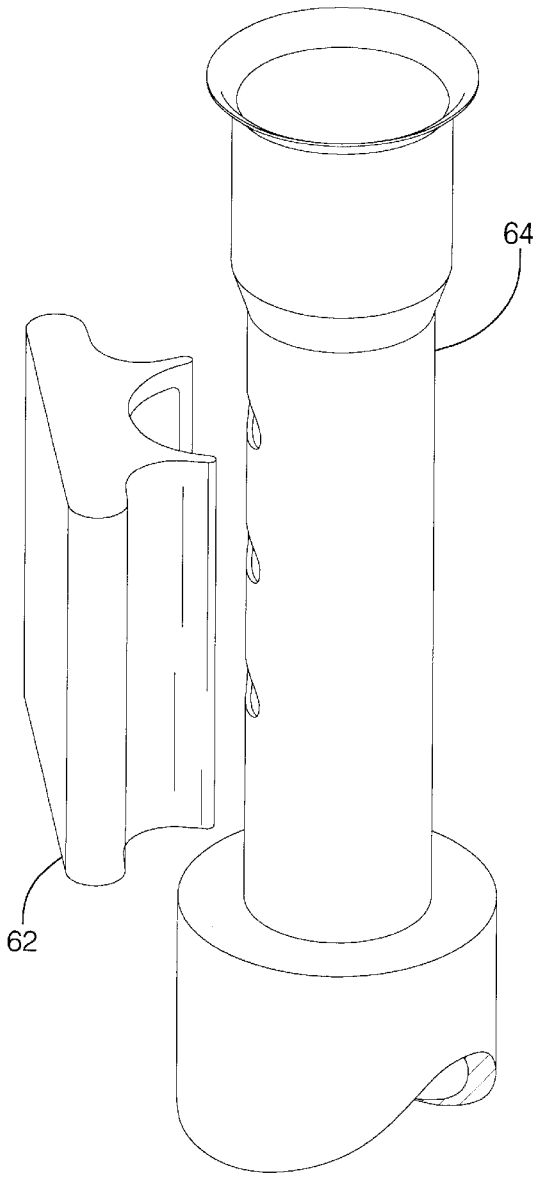
FIG. 4 is an exploded pictorial view illustrating a damper similar to FIG. 2 but with modified configuration.
Figure 5:
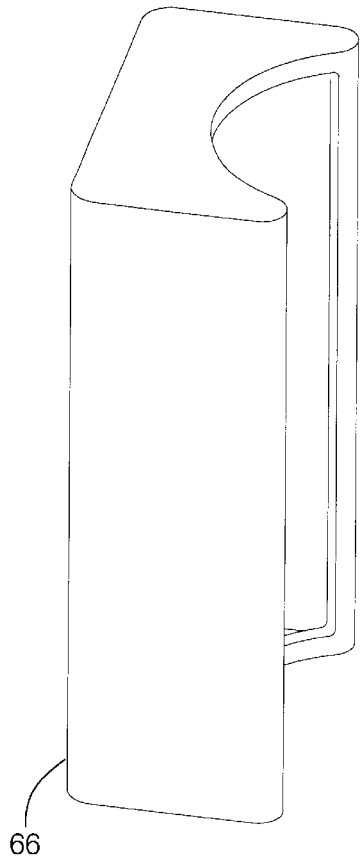
FIG. 5 shows an alternative damper for mounting on the fuel tube of FIG. 4.

FIG. 4 shows a modified damper 62 on a fuel tube 64 similar to FIG. 2. FIG. 5 shows an alternative damper 66 having a similar function.

Figure 6:
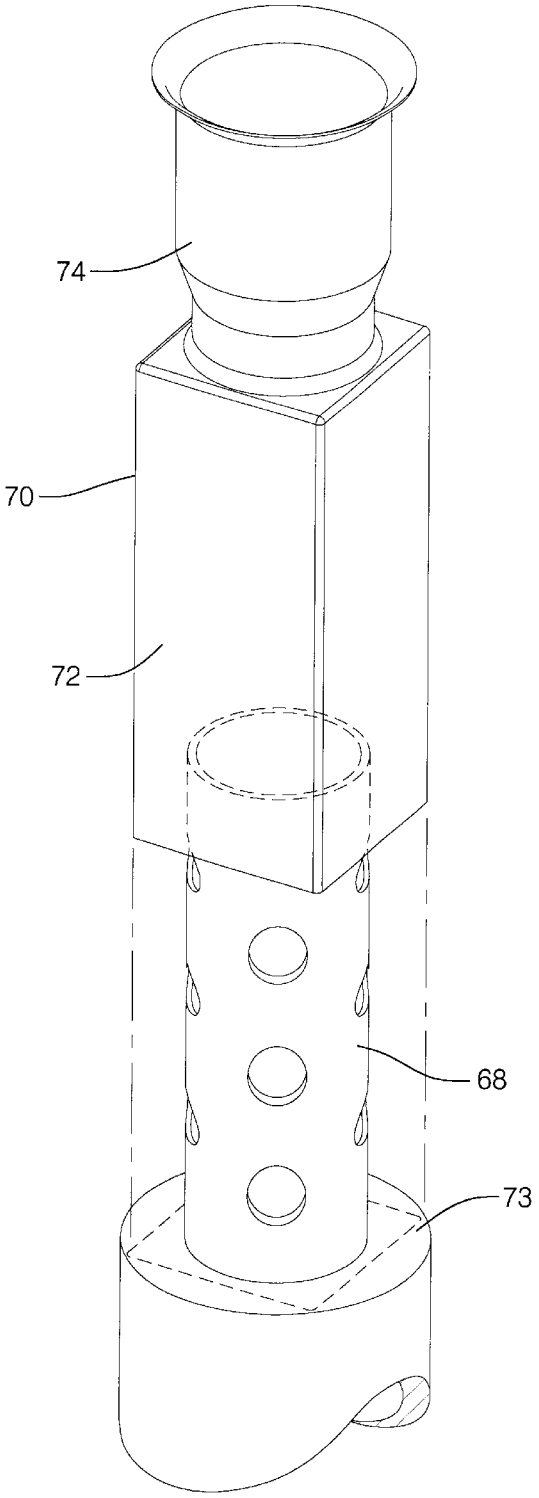
FIG. 6 is an exploded pictorial view of the fuel tube assembly having a square sided damper.

FIG. 6 shows a fuel tube 68 perforated to connect with the interior of a square or polygonal cover 70 having flexible flat sides 72 welded to the base 73 of tube 68 and integral with fuel tube inlet 74.

Figure 7:
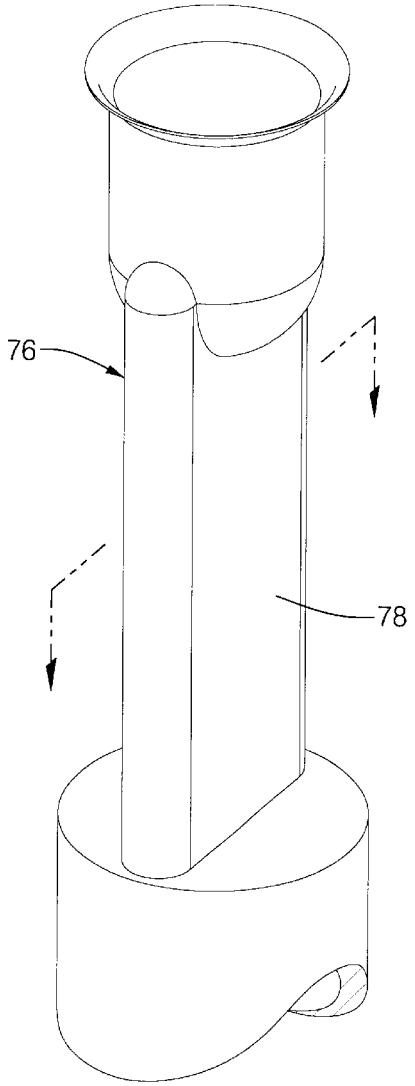
FIG. 7 is a pictorial view of a fuel tube modified to incorporate a flat sided damper.
Figure 8:
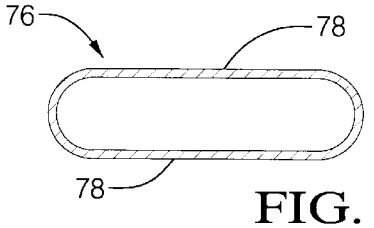
FIG. 8 is a cross sectional view from the line 8—8 of FIG. 7.
Figure 9:
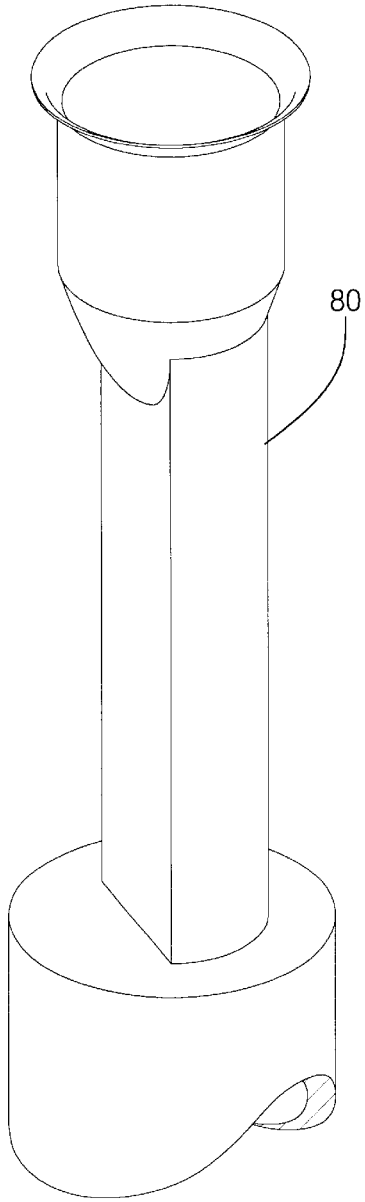
FIG. 9 is a pictorial view similar to FIG. 7 but showing a modified damper configuration and FIGS. 9*a*–9*e* illustrate various possible cross sectional configurations for the damper of FIG. 9.
Figure 9A:
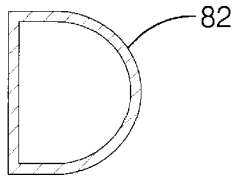
Figure 9B:
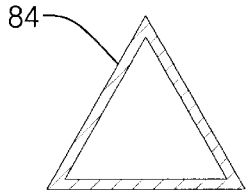
Figure 9C:
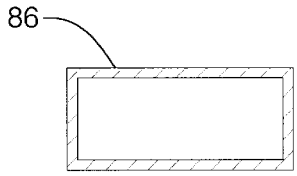
Figure 9D:
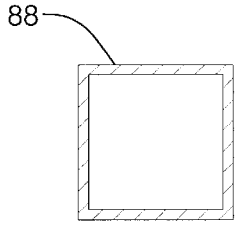
Figure 9E:
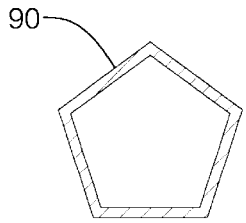

FIGS. 7–9 show embodiments in which the cross-sectional shape of the fuel tube itself is modified. In FIGS. 7 and 8, the fuel tube 76 has a race track cross section with opposite flat sides 78 acting as dampers. FIG. 9 illustrates a differently shaped fuel tube 80. Various alternative configurations are illustrated in FIGS. 9A–9E including D-shaped 82, and polygons including triangle 84, rectangle 86, square 88 and pentagon 90.

In all of FIGS. 3–9E, the flat walls of the damper embodiments flex to vary the volume of fuel in the injector as a function of fuel pressure.

Figure 10:
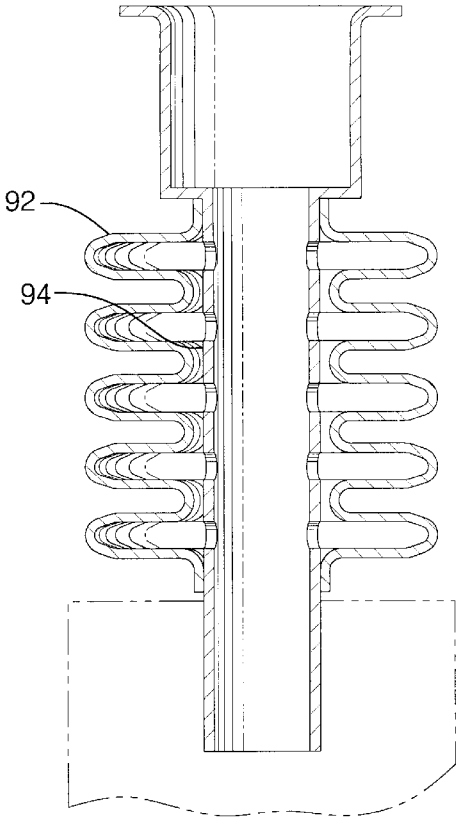
FIGS. 10, 10*a* and 11 are cross sectional views showing various forms of fuel tubes with attached bellows acting as dampers.
Figure 10A:
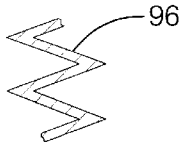
Figure 11:
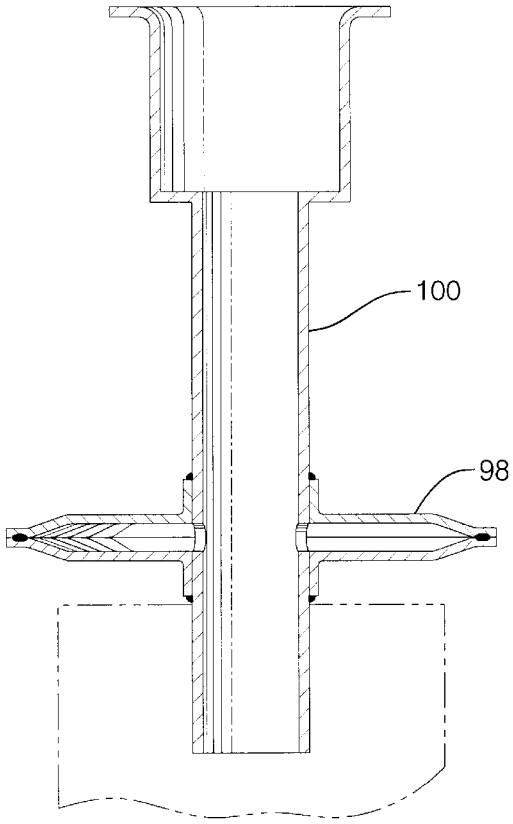

FIGS. 10, 10A and 11 illustrate embodiments having bellows acting as dampers. FIG. 10 shows a sinuous walled bellows 92 surrounding and extending the length of a perforated fuel tube 94. FIG. 10A shows an alternative bellows wall 96 configured with sharp corners and flat sides. FIG. 11 shows a larger dual disc bellows 98 with flat sides welded to the fuel tube 100 at a selected location. Operation of the bellows dampers again varies the fuel volume with pressure by drawing in or expanding of the bellows walls.

FIGS. 12–15 show embodiments with expandable chambers connected with a fuel tube.

Figure 12:
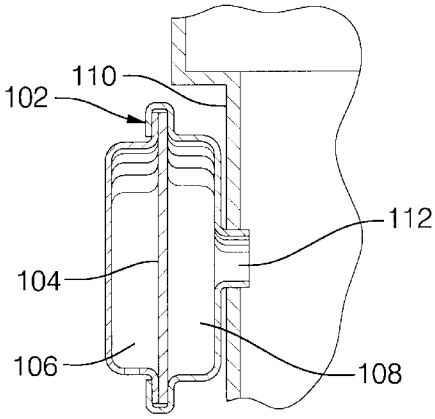
FIGS. 12–15 are cross sectional views showing damper embodiments with expandable chambers on a fuel tube.

FIG. 12 shows a diaphragm housing 102 containing a flexible metallic or elastomeric diaphragm 104 positioned between an ambient pressure chamber 106 and a fuel pressure chamber 108. The housing is mounted on a fuel tube 110 with the diaphragm aligned longitudinally. An open connection 112 is provided for fuel flow between the fuel tube and the fuel pressure chamber 108. In operation, the diaphragm is flexed by fuel pressure to vary the fuel containing volume in an associated injector and reduce the amplitude and frequency of pressure pulsations or waves in the fuel injector.

Figure 13:
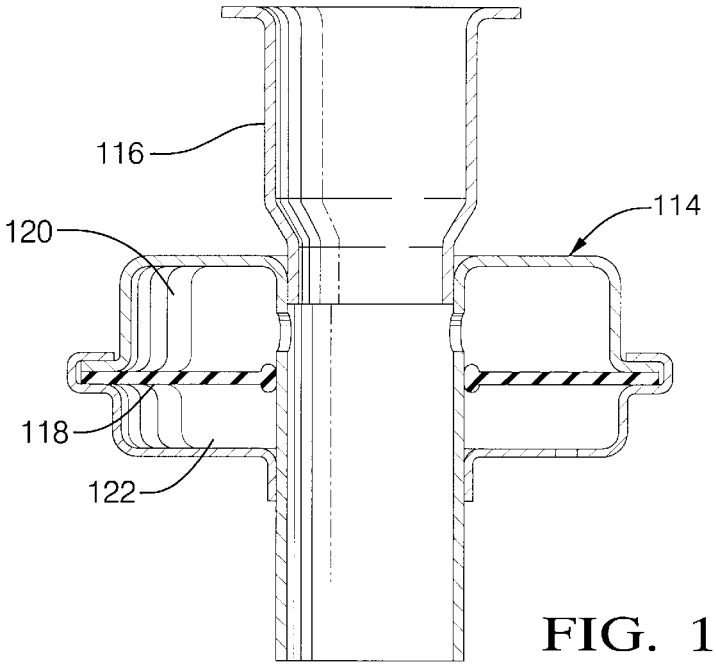

FIG. 13 shows an arrangement functionally similar to that of FIG. 12, but wherein a diaphragm housing 114 is mounted around a fuel tube 116 with a diaphragm 118 extending laterally between chambers 120, 122 open respectively to fuel pressure in the fuel tube and ambient air pressure.

Figure 14:
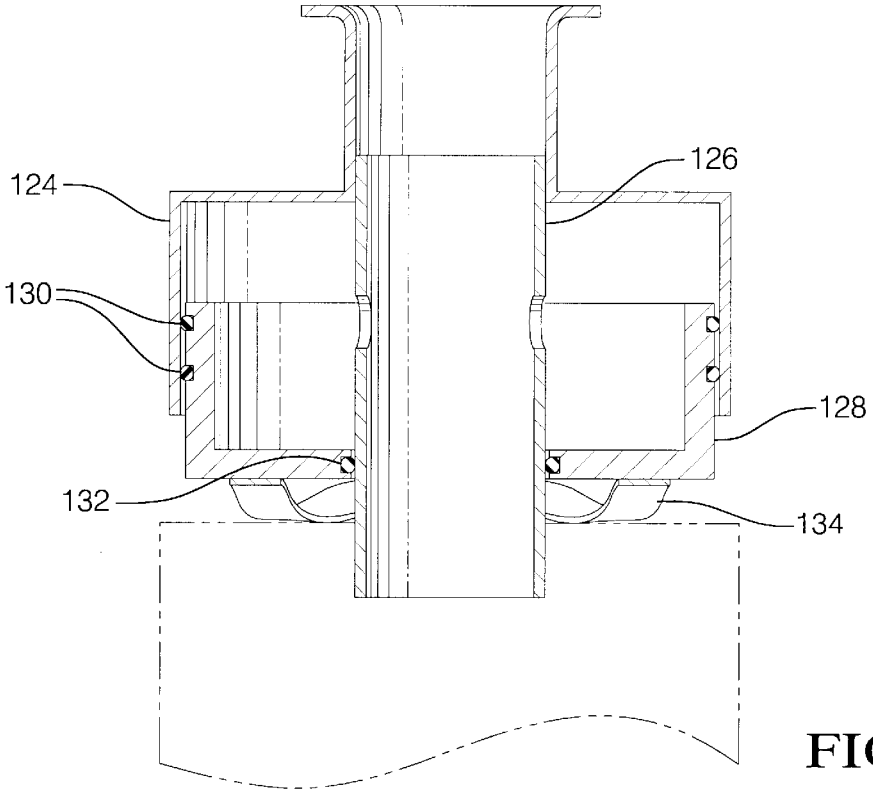

FIG. 14 shows a cylinder 124 surrounding a fuel tube 126 and open to internal fuel pressure. A piston 128 is reciprocable longitudinally in the cylinder 124 and has suitable hydraulic outer and inner seals 130, 132 between the piston 128 and the cylinder 124 and fuel tube 126 respectively. Fuel pressure pulsations in the fuel tube are damped by motion of the piston acting against a return spring 134 of any suitable type, for example, a wave spring.

Figure 15:
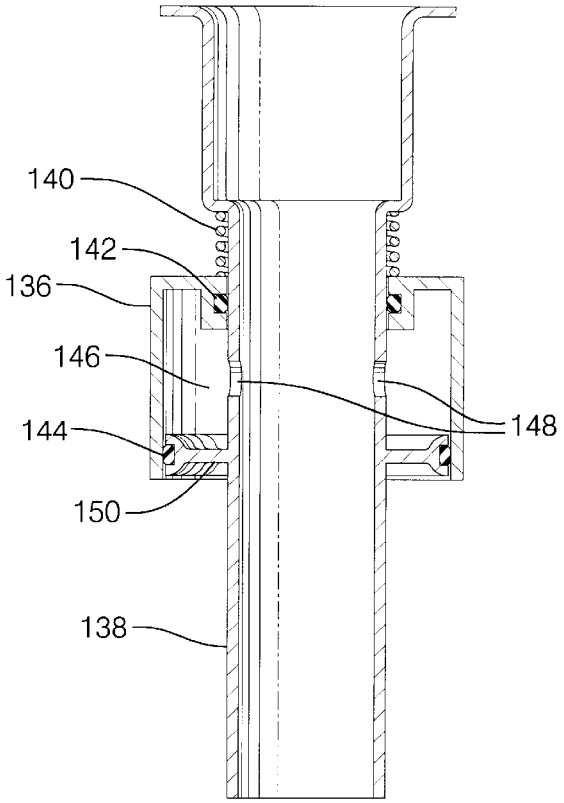

FIG. 15 shows a reciprocable piston 136 mounted around a fuel tube 138 and movable against a spring 140 in response to fuel pressure variations. Seals 142, 144 between the piston and fuel tube seal an internal chamber 146, in the piston, which is connected through holes 148 with the interior of the fuel tube. The piston rides on a stationary wall 150 on the fuel tube at the lower seal 144 to form a differential internal area of the piston responsive to the fuel pressure variations.

FIGS. 16–19 show other variations of resilient wall dampers that could be applied where the available space and operating conditions permit.

Figure 16:
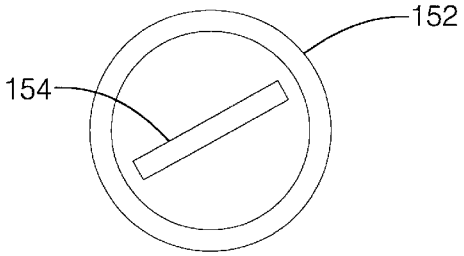
FIGS. 16 and 17 are end views and FIG. 18 is a pictorial view all showing configurations of hollow wall flat or curved dampers.

FIG. 16 shows a conventional (or enlarged) fuel tube 152 having therein a hollow flat wall damper 154 which may be configured like that of the previously mentioned U.S. Pat. No. 6,617,827. The damper 154 must be configured to fit within the fuel tube with a suitable mounting while allowing sufficient fuel flow through the tube 152. Other shapes of dampers could also be internally mounted.

Figure 17:
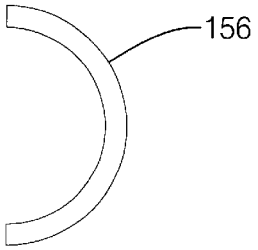
Figure 18:
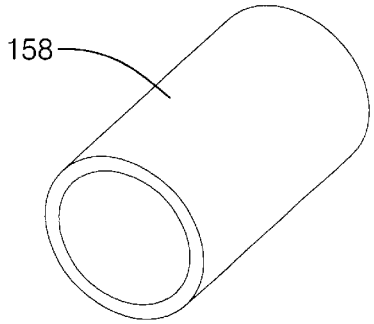

FIGS. 17 and 18 illustrate semicylindrical 156 and cylindrical 158 hollow damper variations which might be mounted in or associated with a fuel tube. The flexible walls could require a more resilient material than the flat wall version of FIG. 16 since the arcuate surfaces would have greater resistance to bending. However, the wall shapes might be varied to provide flat surfaces.

Figure 19:
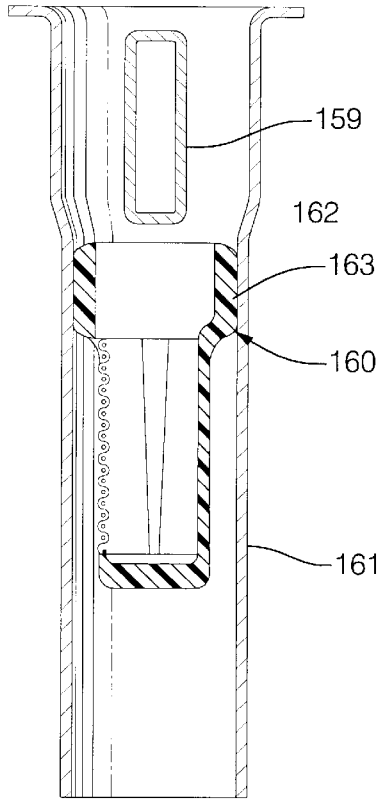
FIG. 19 is a cross sectional view of a fuel tube carrying a fuel filter with an integrated hollow wall damper mounted thereon.

FIG. 19 illustrates integration of a damper 159 into an inlet filter 160 within a fuel tube 161. The filter may have a blow molded frame. The damper 159 is mounted on legs 162 to the base 163 of the filter with openings between the legs allowing a free flow of fuel to the filter 160.

Figure 20:
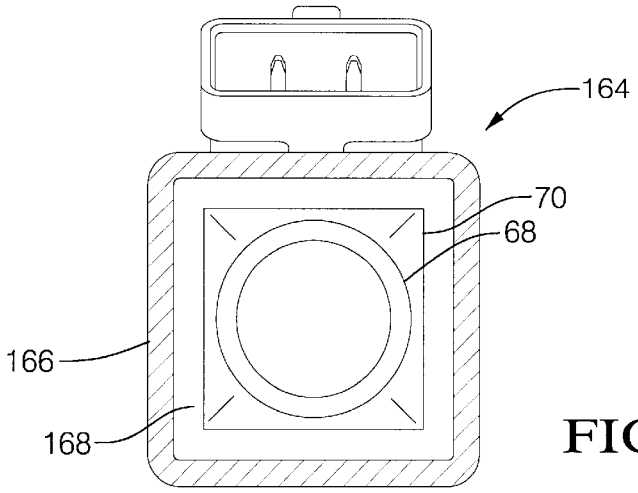
FIG. 20 is a cross sectional view showing a damper similar to FIG. 6 encapsulated within an overmolded upper body.

FIG. 20 is a cross-sectional view through an injector 164 with a damper as in FIG. 6. The view shows how the sheath or cover 70 surrounding the fuel tube 68 may be encapsulated within an overmolded upper body 166 of an injector. The clearance space 168 around the cover 70 could be vented to atmosphere or sealed if desired.

Figure 21:
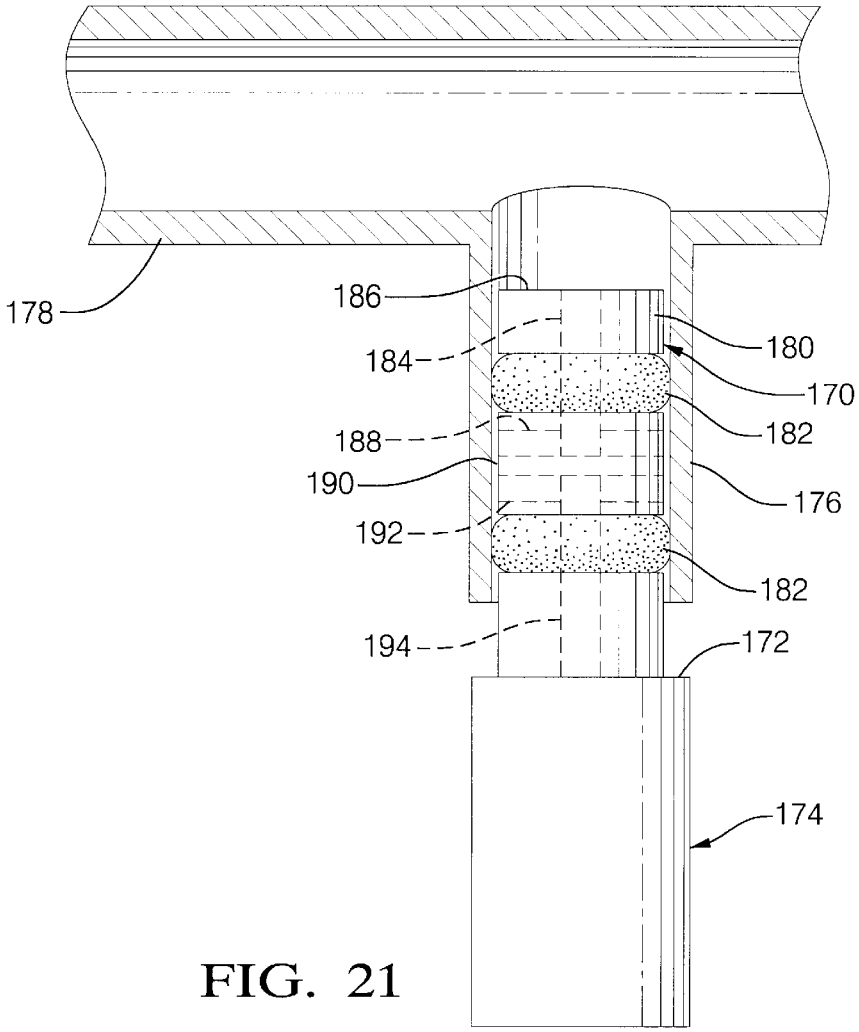
FIG. 21 is a cross sectional view showing an inlet damper with spaced O-rings acting as compliant dampers.

FIG. 21 shows a damper 170 mounted to an inlet end 172 of an injector 174 and received within a fitting or cup 176 of a fuel rail 178. The damper 170 includes a tubular member 180 carrying axially spaced O-rings 182 sealingly engaging the cup 176. An axial fuel passage 184 from the inlet end 186 connects with a radial passage 188 that carries fuel out to an annular clearance 190 between the O-rings. An additional radial passage 192 carries fuel inward again to another axial passage 194 directing fuel into the injector. Pressure pulsations in the inlet act from the clearance 190 against the resilient O-rings 182 which form compliant dampers partially suppressing the pulsations.

Figure 22:
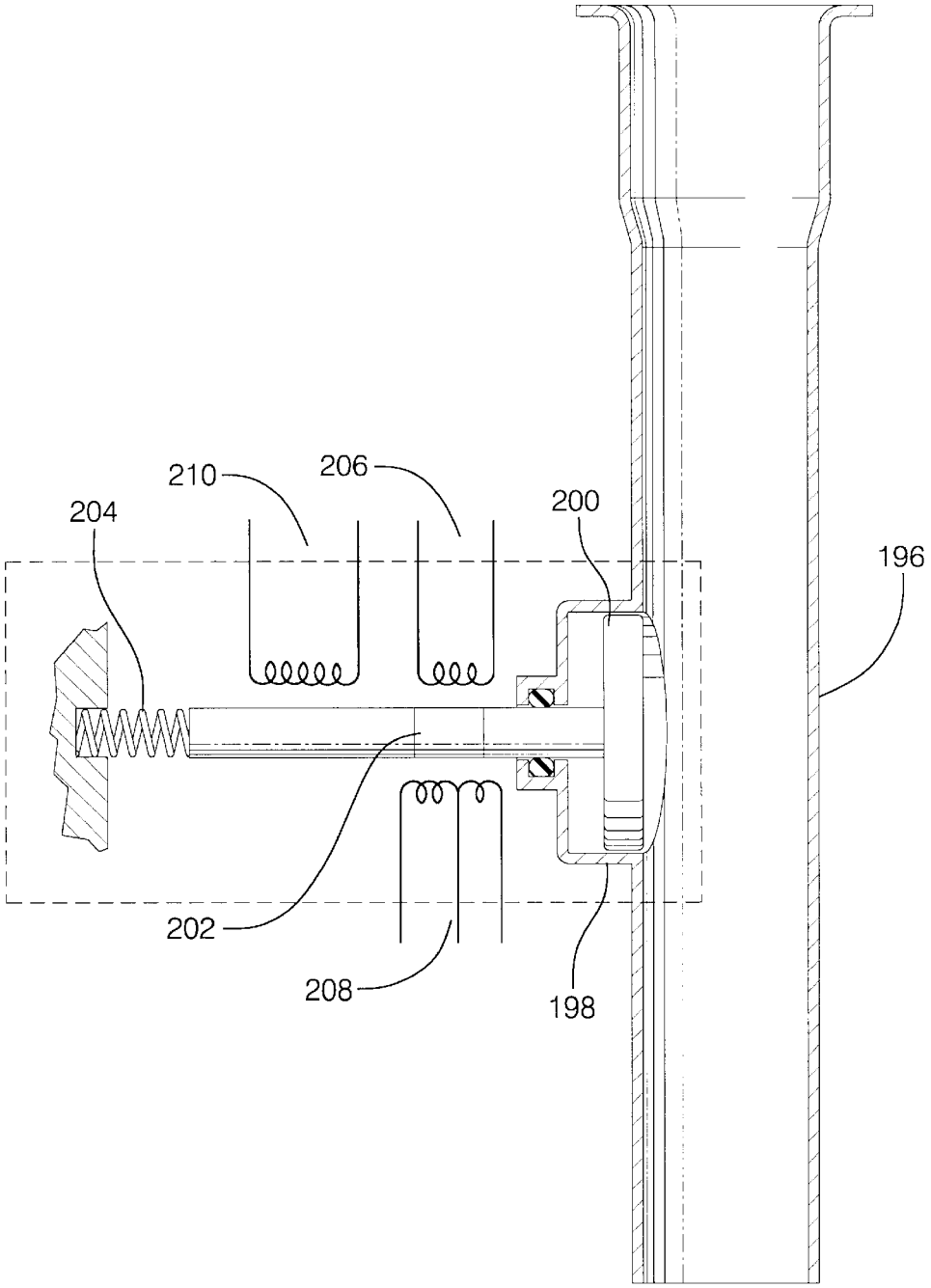
FIGS. 22 and 23 are cross sectional views of active dampers using pulsating pistons connected with a fuel tube.
Figure 23:
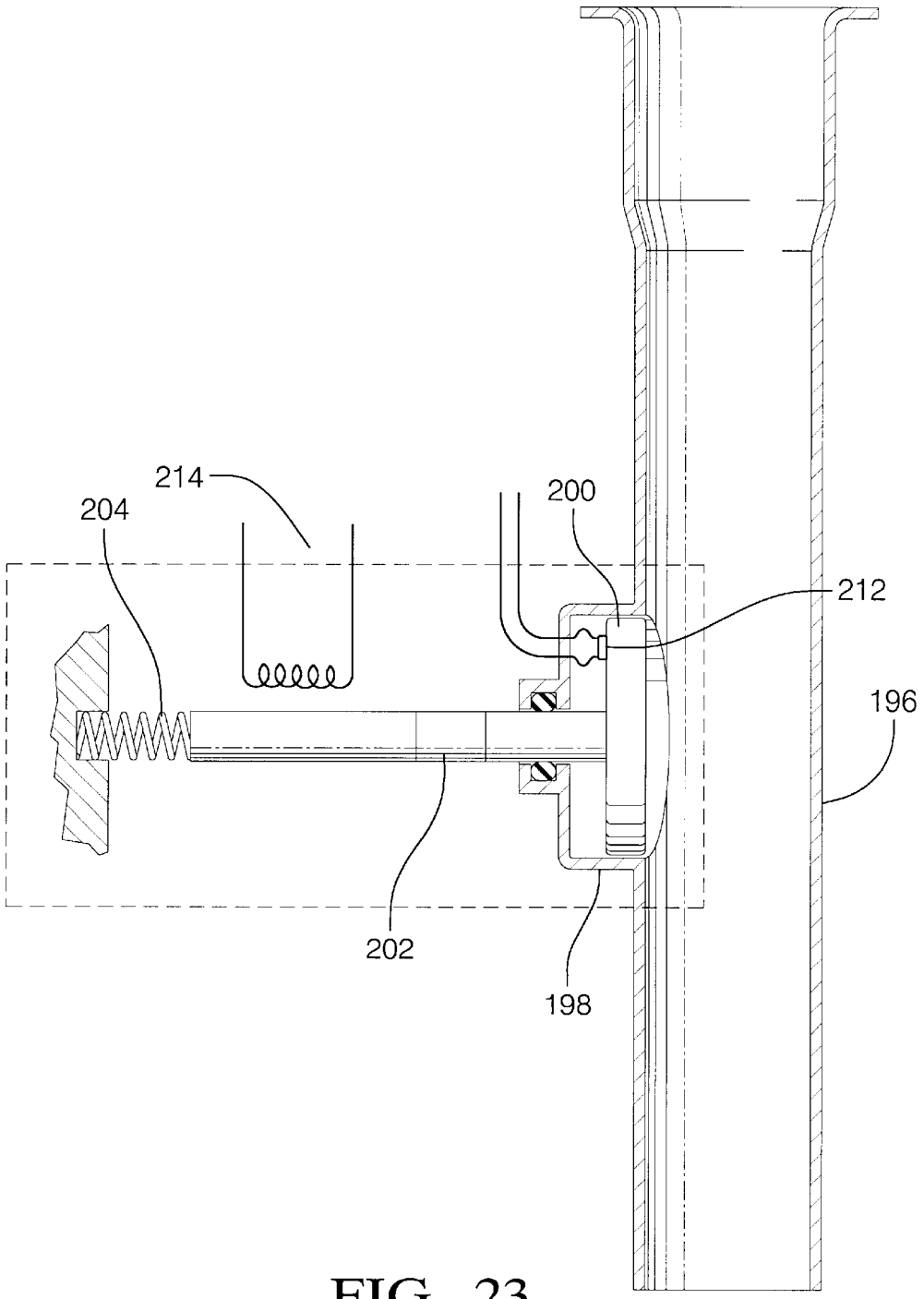
Figure 24:
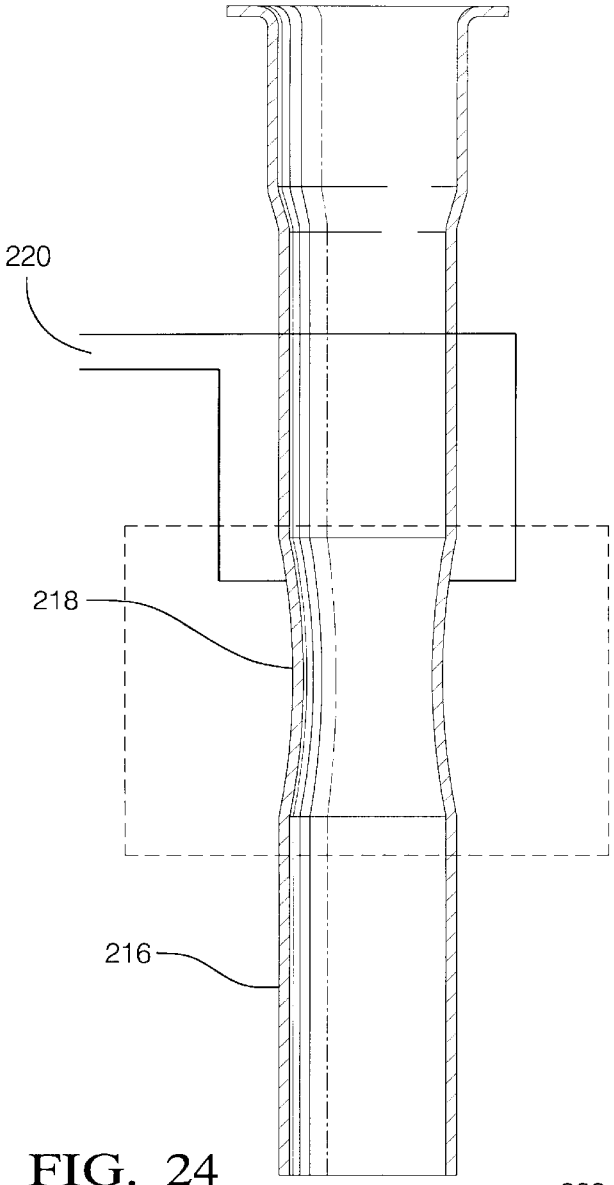
FIG. 24 is a cross sectional view of a fuel tube having a variable size portion made of shape memory alloy.

FIGS. 22–24 schematically show electric or magnetic dampers that are powered to offset or damp pressure pulsations in an injector.

FIG. 22 shows a fuel tube 196 with a connecting cylinder 198 having a piston 200 slidable therein. The piston has a rod carrying a permanent magnet 202 and engaging a return spring 204 urging the piston toward a null position. Pressure pulsations in the fuel tube reciprocate the piston against the spring. An excitation coil 206 is energized from a control source, not shown, for a linear voltage differential transformer (LVDT) and feeds the control source from an output coil 208. Movement of the magnet 202 between the excitation coil 206 and output coil 208 provides an output signal to the control source from the output coil 208 that is proportional to the pressure pulsation in the injector. The control source then powers a drive coil 210 that acts on the magnet 202 to pulse the piston 200 in a series of on/off pulses that reduce the amplitude of the pulsations. The drive coil 210 is deenergized when the pulsations are no longer sensed by the excitation coil 206. If desired, control logic could be developed to lead the expected pulsations in a manner similar to the reduction of audio noise by offsetting the pressure waves. Thus control of the piston motion can be passive or active as desired.

FIG. 23 shows schematically a variation of the embodiment of FIG. 22 wherein like numerals indicate like features. The fuel tube 196, cylinder 198 piston 200, magnet 202 and return spring 204 are as in FIG. 22. Movement of the piston is sensed by a strain gage 212 which operates through a control source, not shown, to energize a drive coil 214. The drive coil then drives the piston to offset or damp the pulsations as described above for FIG. 22.

FIG. 24 illustrates an embodiment wherein a fuel tube 216 includes an expandable portion 218 made from a shape memory alloy which is variable by the application of voltage. The portion 218 is connected with a source of controlled voltage 220 that is actuated by the occurrence of pressure pulsations in the fuel tube 216. The expandable portion 218 is of slightly smaller diameter and is expanded as called for by the application of the controlled voltage 220 to offset or damp the pulsations and eliminate or reduce their effects. The shape memory alloy portion 218 could also be made as a large flat plate area that expands outwardly in response to an electrical signal.

Figure 25:
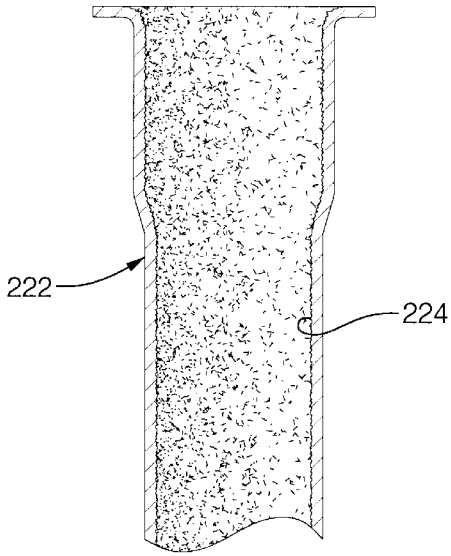
FIG. 25 is a cross sectional view of a fuel tube in which damping is provided by a roughened internal surface.

FIG. 25 shows still another embodiment that includes a fuel tube 222 having a roughened internal surface 224. The rough surface creates turbulence along the walls of the tube. The turbulence has the effect of dampening the propagation of pressure waves along the tube. The effects of pressure waves created by opening and closing of the injector valve are thereby reduced along with the adverse effects that may be caused by such waves, or pressure pulsations.

While the invention has been described by reference to a number of exemplary embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An engine fuel injector comprising:

an internal fuel passage in the injector and having an inlet end and an outlet end, the inlet end being connectable with an external supply of fuel under pressure for supplying pressurized fuel to the fuel passage, and the outlet end including an injection valve rapidly operable to selectively open and close the fuel passage to the discharge of fuel from the injector through the valve, whereby rapid changes in the rate of fuel flow through the injector may cause rapid variations in fuel pressure in the injector; and a fuel pressure damper in the injector and associated with the internal fuel passage between the inlet and outlet ends, wherein the damper includes a variable volume chamber associated with the fuel passage and responsive to pressure variations in the fuel passage to vary the chamber volume, thus reducing the amplitude of the pressure variations in the fuel passage and thereby reducing changes in the rate of fuel flow upon opening and closing of the injection valve.

2. An engine fuel injector as in claim 1 wherein the damper includes fuel turbulating means in the fuel passage.

3. An engine fuel injector as in claim 1 wherein the damper is a hollow body having at least one resilient side defining the variable volume chamber.

4. An engine fuel injector as in claim 3 wherein the hollow body is within the fuel passage and the variable volume chamber is an enclosed gas filled chamber internally separate from the fuel passage.

5. An engine fuel injector as in claim 1 wherein the variable volume chamber is connected with the fuel passage and includes at least one movable side.

6. An engine fuel injector as in claim 5 wherein the movable side is a resilient flat sheet.

7. An engine fuel injector as in claim 5 wherein the movable side is in a bellows.

8. An engine fuel injector as in claim 5 wherein the movable side is a piston.

9. An engine fuel injector as in claim 8 wherein the piston is actively driven to increase the damping of pressure variations in the fuel passage.

10. An engine fuel injector as in claim 5 wherein the movable side is a resilient seal ring.

11. An engine fuel injector as in claim 5 wherein the movable side is a shape memory alloy forming a wall of the fuel passage and movable by electric voltage application.

12. An engine fuel injector as in claim 2 wherein the turbulating means is a roughened surface of the fuel tube.

* * * * *